US008995871B2

(12) United States Patent
Shibazaki

(10) Patent No.: US 8,995,871 B2
(45) Date of Patent: Mar. 31, 2015

(54) POWDER COLLECTING DEVICE

(75) Inventor: Takao Shibazaki, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/604,321

(22) Filed: Sep. 5, 2012

(65) Prior Publication Data

US 2013/0071137 A1 Mar. 21, 2013

(30) Foreign Application Priority Data

Sep. 16, 2011 (JP) ..... 2011-202492

(51) Int. Cl.
*G03G 21/10* (2006.01)

(52) U.S. Cl.
CPC ..... *G03G 21/105* (2013.01)
USPC ..... 399/102; 399/360

(58) Field of Classification Search
CPC ..... G03G 21/10; G03G 21/105; G03G 2221/0005; G03G 2221/1624; G03G 2221/1648
USPC ..... 399/102, 103, 105, 358, 360, 123, 110, 399/120
See application file for complete search history.

(56) References Cited

U.S. PATENT DOCUMENTS 5,937,235 A * 8/1999 Huss et al. ..... 399/102
2006/0083540 A1* 4/2006 Kadowaki et al. ..... 399/102

FOREIGN PATENT DOCUMENTS

JP S61-203358 A 9/1986
JP 2006-338053 12/2006
JP 2010-085458 4/2010
JP 2010-281868 12/2010
JP 2011-95494 5/2011

OTHER PUBLICATIONS

Machine translation of JP 2006-338053 dated Jan. 17, 2014.*
Notification of Reasons for Refusal mailed Oct. 22, 2013, directed to JP Application No. 2011-202492; 5 pages.

* cited by examiner

*Primary Examiner* — Sophia S Chen
(74) *Attorney, Agent, or Firm* — Lucas & Mercanti, LLP

(57) ABSTRACT

A powder collecting device for conveying toner, a developer, waste toner and/or a waste developer in a conveyance pipe in one direction and for dropping it into a container through an opening made at an end of the conveyance pipe. The container is mountable in a body of an image forming apparatus such that the end of the conveyance pipe is inserted into the container, and is dismountable therefrom. An elastic sealing member, which has a larger area than a cross-sectional area of the end of the conveyance pipe, is attached to a portion of the container through which the end of the conveyance pipe is inserted into the container. A plurality of cuts are made in the sealing member such that the sealing member has at least an upper flap having a longer elastically deformable portion and a lower flap having a shorter elastically deformable portion.

3 Claims, 4 Drawing Sheets

POWDER COLLECTING DEVICE

This application is based on Japanese Patent Application No. 2011-202492 filed on Sep. 16, 2011, the content of which is incorporated herein by reference.

BACKGROUND OF THE INVENTION

1. Field of the Invention

The present invention relates to a powder collecting device, particularly to a powder collecting device for collecting powder, such as toner, a developer, waste toner and a waste developer, in an electrophotographic copier or printer.

2. Description of Related Art

Generally, an electrophotographic image forming apparatus is provided with a waste powder collecting device for collecting waste toner removed from an image support member, such as a photoreceptor, or for collecting a waste developer removed from a developing device. In this type of collecting device, as shown by FIG. 8, waste toner or a waste developer is fed in a conveyer pipe 105 in a direction shown by arrow B by a conveyer screw 131, and the waste toner or the waste developer is dropped through an opening 132 made at an end of the pipe 105 to be received in a specified position of a container 120.

The container 120 is mountable in and dismountable from a body of an image forming apparatus. When the container 120 is mounted in the body of the image forming apparatus, an end of the conveyer pipe 105 is inserted in the container 120. An elastic sealing member 125 as shown by FIG. 9 is attached to an open end of the container 120 through which the end of the conveyer pipe 105 is inserted. Cuts 126 are radially made in the sealing member 125, whereby tongue-like flaps 127*a* and 127*b* are formed. When the end of the conveyer pipe 105 is inserted in the container 120, as shown in FIG. 8, the flaps 127*a* and 127*b* are bent by the end of the pipe 105, and when the container 120 is dismounted from the body of the image forming apparatus, as shown by FIG. 9, the sealing member 125 returns to its original state to close the open end of the container 120.

Since the flaps 127*a* and 127*b* are formed by the cuts 126 made radially from the axis of the conveyer pipe 105, the upper flaps 127*b* and the lower flaps 127*a* are relatively long. Especially the lower flaps 127*a* extend to the opening 132, and therefore, waste toner T adheres to the tips of the lower flaps 127*a*. When the container 120 is dismounted from the body of the container 120, the lower flaps 127*a* return to the upstanding states, and in this moment, the waste toner T comes off from the tips of the flaps 127*a* and begrimes the inside of the apparatus, the floor and/or the user's hand. As the container 120 is mounted in and dismounted from the body of the image forming apparatus, the tips of the lower flaps 127*a* may be caught between the opening 132 of the pipe 105 and a shutter 133, and may be torn. Additionally, in order to comply with a demand for downsizing of the whole image forming apparatus, the space for insertion of the conveyer pipe 105 into the container 120 needs to be reduced. Accordingly, the tips of the lower flaps 127*a* may cover a large part of the opening 132, thereby obstructing the drop of the waste toner T and increasing the amount of waste toner T adhering to the lower flaps 127*a*.

A sealing member for a toner container disclosed by Japanese Patent Laid-Open Publication No. 2010-085458 has cuts in different places on the outer surface and on the inner surface of the sealing member so as to achieve excellent sealing performance. This sealing member certainly has improved sealing performance, but this sealing member does not solve the problem that toner adheres to flaps of the sealing member, thereby causing the other components to be begrimed.

SUMMARY OF THE INVENTION

An aspect of the present invention relates to a powder collecting device for conveying at least one of toner, a developer, waste toner and a waste developer in a conveyance pipe in one direction and for dropping the at least one of toner, a developer, waste toner and a waste developer into a container through an opening made at one end of the conveyance pipe, and in the powder collecting device according to an embodiment of the present invention, the container is mountable in a body of an image forming apparatus such that the one end of the conveyance pipe is inserted in the container, and the container is dismountable from the body of the image forming apparatus, an elastic sealing member, which has a larger area than a cross-sectional area of the one end of the conveyance pipe, is attached to a portion of the container through which the one end of the conveyance pipe is inserted into the container, and a plurality of cuts are made in the sealing member such that the sealing member has a plurality of flaps including at least a flap located in an upper side and a flap located in a lower side, the flap located in the lower side having an elastically deformable portion that is shorter than that of the flap located in the upper side.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

A powder collecting device according to an embodiment will be hereinafter described with reference to the drawings.

Figure 1:
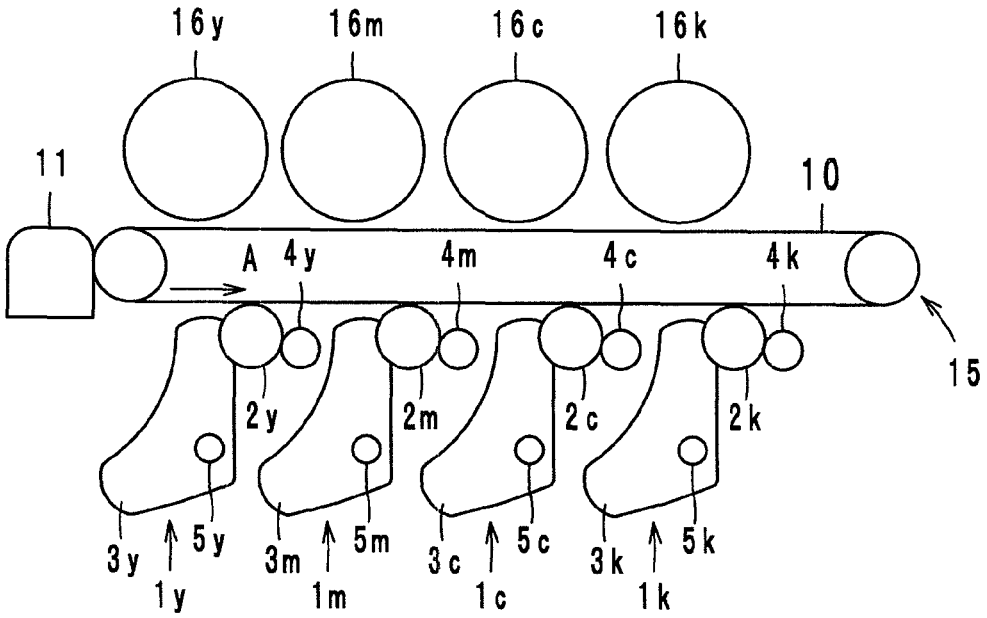
FIG. 1 is a schematic view of a main part of an image forming apparatus.

An image forming apparatus shown by FIG. 1 is a tandem-type color image forming apparatus. In the color image forming apparatus, image formation units 1, each of which includes a photosensitive drum 2, are arranged side by side, and toner images formed on the respective photosensitive drums 2 are transferred onto an intermediate transfer belt 10 that rotates in a direction shown by arrow A to be combined into a full-color image (primary transfer). Thereafter, the full-color image is transferred onto a sheet (not shown) by a secondary transfer member 15 (secondary transfer). In FIG.

1, the reference numbers provided with alphabets "y", "m", "c" and "k" denote members in association with image formation of yellow, magenta, cyan and black, respectively.

Figure 2:
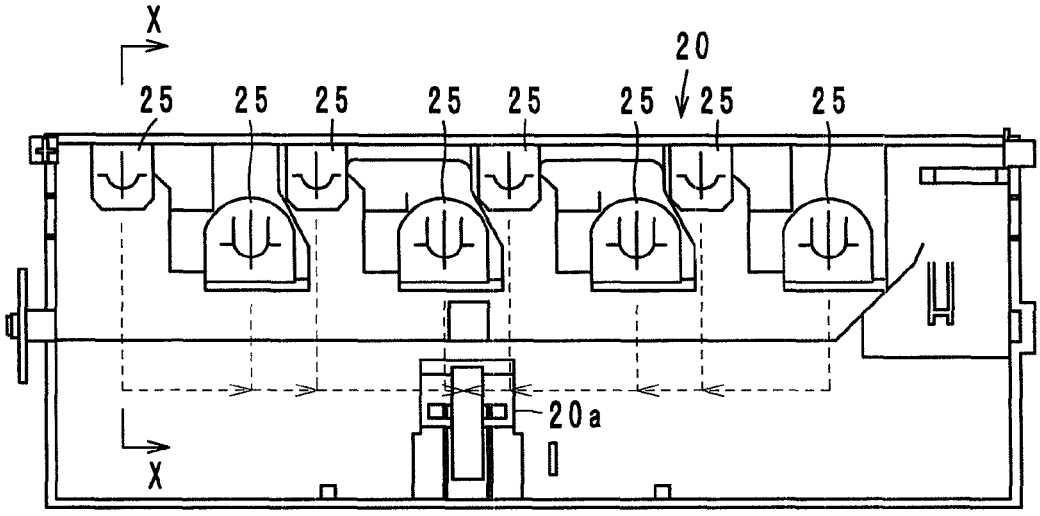
FIG. 2 is a front view of a waste powder collecting device.

Each of the image formation units 1 is mainly composed of a photosensitive drum 2 and a developing device 3. Waste toner removed from the photosensitive drum 2 is conveyed to a container 20 as shown by FIG. 2 through a pipe 4, and a waste developer including waste toner and carriers removed from the developing device 3 are conveyed to the container 20 through a pipe 5. In the container 20, waste powder conveyed thereto is collected in a central part 20*a* through paths shown by dotted lines, and a volume sensor (not shown) detects the volume of the collected waste powder. The structure for the conveyance of waste powder inside the container 20 is similar to the structure disclosed by Japanese Patent Laid-Open Publication No. 2010-145812.

Further, toner bottles 16 containing toner are arranged above the intermediate transfer belt 10. Residual toner on the intermediate transfer belt 10 is removed by a cleaning device 11, and the waste toner removed therefrom is collected in the container 20 by a collecting mechanism that is basically of the same structure as described below. A description of a route used for collection of waste toner from the intermediate transfer belt 10 is omitted.

Figure 3:
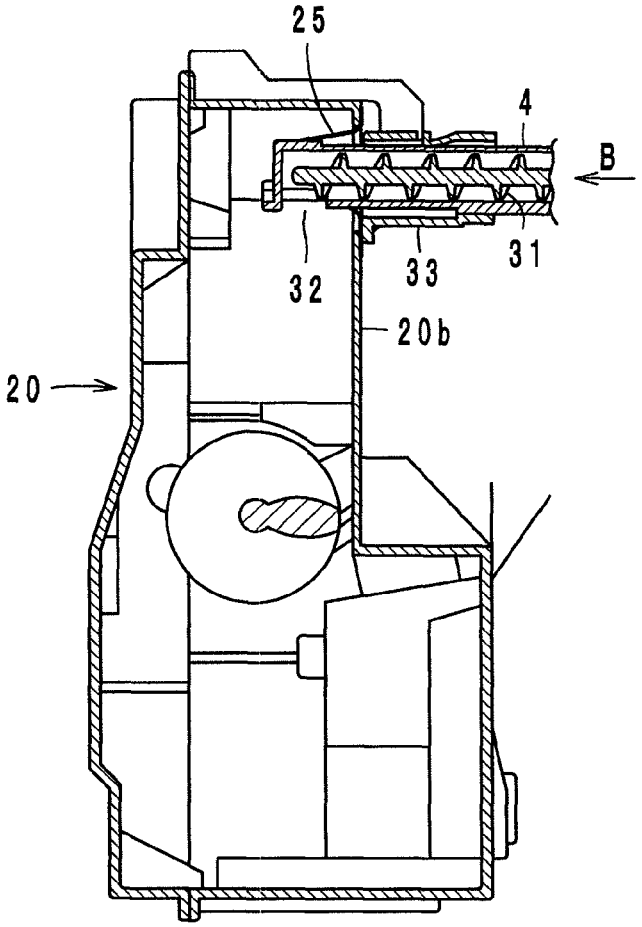
FIG. 3 is a sectional view of the waste powder collecting device taken along a line X-X in FIG. 2.
Figure 4:
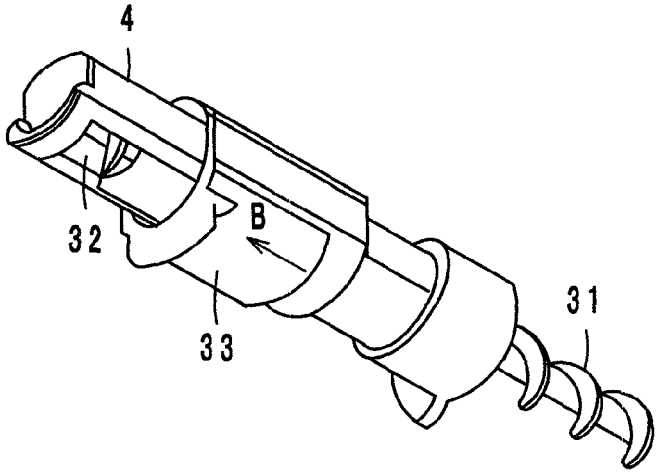
FIG. 4 is a perspective view of an end portion of a conveyer pipe.

The container 20, as shown in FIG. 3, is mountable in a body of the image forming apparatus such that one end of the pipe 4 can be inserted therein, and the container 20 has eight holes for receiving end portions of the eight pipes 4 and 5 shown in FIG. 1. As shown by FIGS. 3 and 4, a screw 31 is provided in the pipe 4 and is driven to rotate in one direction. With the rotation of the screw 31, waste toner is conveyed in a direction shown by arrow B toward the end inserted in the container 20. The pipe 4 has an opening 32 in the inserted end portion at the bottom, and a shutter 33 is provided to cover the opening 32 and is pushed by a spring (not shown) in the direction of arrow B. When the container 20 is mounted in the body of the image forming apparatus, the shutter 33 is stopped by a wall 20*b* of the container 20, thereby uncovering the opening 32. When the container 20 is dismounted from the body of the image forming apparatus, the shutter 33 is revealed from the wall 20*b*, thereby covering the opening 32. FIG. 4 shows a state where the shutter 33 uncovers the opening 32.

Figure 6A:
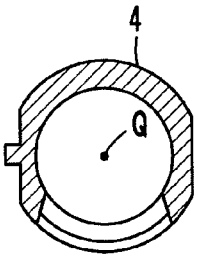
FIG. 6*a* is a sectional view of the conveyer pipe.

The holes of the container 20 are covered with sealing members 25. The sealing members 25 are elastic sheets, and sponge or foamable resin is suited to be used as the material of the sealing members 25. FIG. 6*a* shows a cross section of the pipe 4. FIGS. 6*b*, 6*c*, 7*a* and 7*b* show the positional relation between the cross-section of the pipe 4 (the dotted circle showing the internal wall of the pipe 4) and the sealing member 25. Specifically, a plurality of cuts 26 is made in the sealing member 25 such that a plurality of upper and lower tongue-like flaps 27*a* and 27*b* can be formed and such that elastically deformable portions of the lower flaps 27*a* are shorter than those of the upper flaps 27*b*. That is, the cuts 26 intersect with each other at a point P located below the center of the circle Q of the cross-section of the pipe 4. The cuts 26 may be made in various ways, and in other words, the flaps 27*a* and 27*b* may be made into various shapes. FIGS. 6*b*, 6*c*, 7*a* and 7*b* show typical shapes of the flaps 27*a* and 27*b*.

Figure 5:
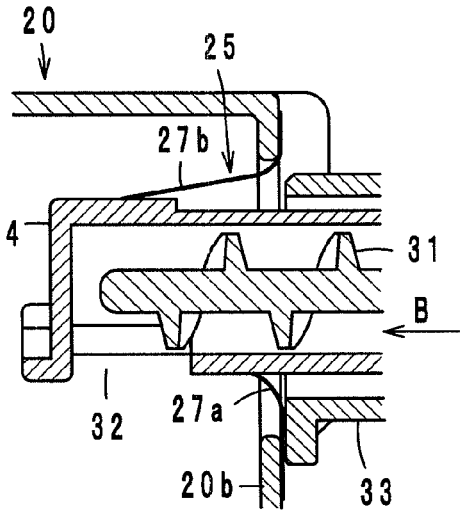
FIG. 5 is an enlarged sectional view of a main part of the waste powder collecting device.

When the end portion of the pipe 4 is inserted in the container 20, as shown by FIG. 5, the flaps 27*a* and 27*b* of the sealing member 25 are bent by the end portion of the pipe 4. When the container 20 is dismounted from the body of the image forming apparatus, the flaps 27*a* and 27*b* return to a flat state to cover the hole (where the pipe 4 is inserted) of the container 20.

Since the lower flaps 27*a* have short elastic-deformable portions, the tips of the lower flaps 27*a* are stopped by the lower surface of the pipe 4 and do not reach the opening 32. Therefore, in the state shown by FIG. 5, there is no possibility that waste powder may adhere to the lower flaps 27*a*. Accordingly, when the container 20 is dismounted from the body of the apparatus, that is, when the lower flaps 27*a* return to the sealing positions, it never occurs that waste powder drops out of the container 20. Further, there is no fear that the lower flaps 27*a* may block the opening 32 of the pipe 4 and may be caught between the opening 32 and the shutter 33.

Figure 6B:
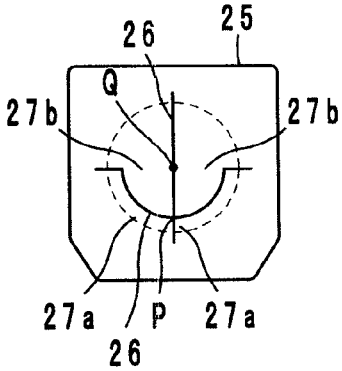
FIGS. 6*b* and 6*c* are front views of a sealing member showing cuts made thereon.
Figure 6C:
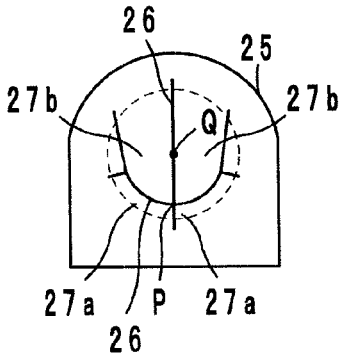
Figure 7A:
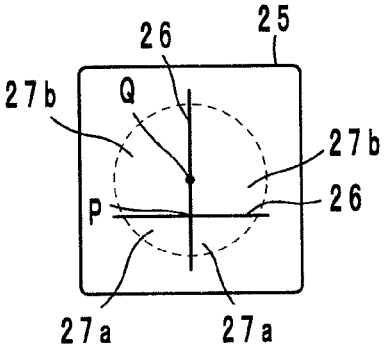
FIGS. 7*a* and 7*b* are front views of a sealing member showing cuts made thereon.
Figure 7B:
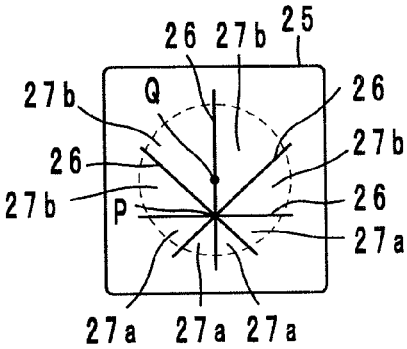
Figure 8:
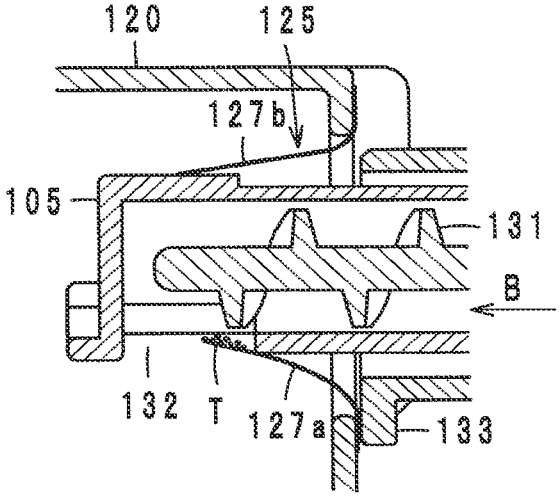
FIG. 8 PRIOR ART
FIG. 8 is an enlarged sectional view of a main part of a conventional waste powder collecting device.
Figure 9:
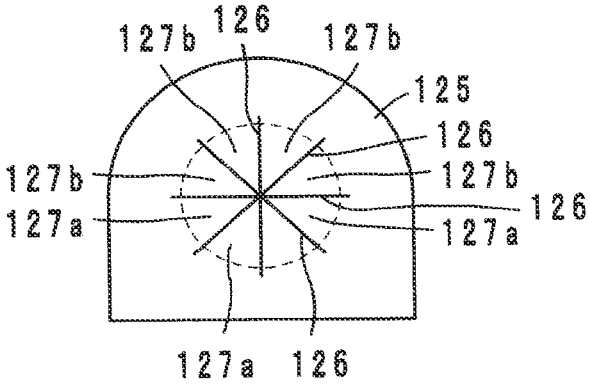
FIG. 9 PRIOR ART
FIG. 9 is a front view of a conventional sealing member showing cuts made therein.

The cuts 26 made in the sealing member 25 may be linear as shown by FIGS. 7*a* and 7*b*, or alternatively may include an arc-like cut as shown by FIGS. 6*b* and 6*c*. Especially when an arc-like cut 26 along the cross-section of the pipe 4 is made in the sealing member 25, a spill of waste powder can be effectively prevented without causing degradation of the sealing performance.

The present invention provides not only the waste powder collecting device according to the embodiment described above but also various modified devices including the gist of the present invention.

Especially the electrophotographic image formation units may be of an arbitrary structure, and the details of the container and the details of the shape of the sealing member may be designed arbitrarily. Further, the present invention is applicable not only to a collecting device for collecting waste toner and/or a waste developer but also to a supply device for supplying toner and/or a developer to a developer bottle.

Although the present invention has been described in connection with the preferred embodiment, it is to be noted that various changes and modifications are possible for those who are skilled in the art. Such changes and modifications are to be understood as being within the scope of the present invention.

What is claimed is:

1. A powder collecting device for conveying at least one of toner, a developer, waste toner and a waste developer in a conveyance pipe in one direction and for dropping the at least one of toner, a developer, waste toner and a waste developer into a container through an opening made at one end of the conveyance pipe, wherein: the container is mountable in a body of an image forming apparatus such that the one end of the conveyance pipe is inserted in the container, and the container is dismountable from the body of the image forming apparatus; an elastic sealing member, which has a larger area than a cross-sectional area of the one end of the conveyance pipe, is attached to a portion of the container through which the one end of the conveyance pipe is inserted into the container; and a plurality of cuts are made in the sealing member such that the sealing member has a plurality of flaps including at least a flap located in an upper side and a flap located in a lower side, the flap located in the lower side having an elastically deformable portion that is shorter than that of the flap located in the upper side, wherein, at least one of the cuts made in the sealing member is along the cross-section of the one end of the conveyance pipe, and wherein the plurality of cuts intersect with each other only at one or more points located below a center of a cross-section at the one end of the conveyance pipe.

2. A powder collecting device according to claim 1, wherein a tip of the flap located in the lower side does not reach to the opening made at the one end of the conveyance pipe.

3. The powder collecting device according to claim 1, wherein the cut made in the sealing member along the cross-section of the one end of the conveyance pipe is located only below a center of the cross-section at the one end of the conveyance pipe so as to cut the sealing member into the flap located in the upper side and the flap located in the lower side.

* * * * *